United States Patent [19]

Froes et al.

[11] Patent Number: 4,851,053

[45] Date of Patent: Jul. 25, 1989

[54] METHOD TO PRODUCE DISPERSION STRENGTHENED TITANIUM ALLOY ARTICLES WITH HIGH CREEP RESISTANCE

[75] Inventors: Francis H. Froes, Xenia; Daniel Eylon, Dayton, both of Ohio

[73] Assignee: The United States of America as represented by the Secretary of the Air Force, Washington, D.C.

[21] Appl. No.: 198,801

[22] Filed: May 6, 1988

[51] Int. Cl.[4] ..... C21D 1/00; C22F 1/18

[52] U.S. Cl. ..... 148/11.5 F; 148/20.3; 148/133

[58] Field of Search ..... 148/11.5 F, 20.3, 133

[56] References Cited

U.S. PATENT DOCUMENTS

| | | | |
|---|---|---|---|
| 2,892,742 | 6/1959 | Zwicker et al. | 148/11.5 F |
| 3,070,468 | 12/1962 | Grant | 148/11.5 F |
| 4,415,375 | 11/1983 | Lederich et al. | 148/11.5 F |
| 4,505,764 | 3/1985 | Smickley et al. | 148/133 |
| 4,512,826 | 4/1985 | Whang | 148/407 |
| 4,612,066 | 9/1986 | Levin et al. | 148/133 |
| 4,624,714 | 11/1986 | Smickley et al. | 148/133 |
| 4,680,063 | 7/1987 | Vogt et al. | 148/133 |
| 4,808,249 | 2/1989 | Eylon et al. | 148/11.5 F |
| 4,808,250 | 2/1989 | Froes et al. | 148/11.5 F |

OTHER PUBLICATIONS

Kerr et al., "Hydrogen as an Alloying Element in Titanium (Hydrovac)", Titanium '80 Science and Technology, 1980, pp. 2477–2486.

*Primary Examiner*—L. Dewayne Rutledge
*Assistant Examiner*—David Schumaker
*Attorney, Agent, or Firm*—Charles E. Bricker; Donald J. Singer

[57] ABSTRACT

A method to produce titanium alloy articles having high creep resistance which comprises the steps of:

(a) providing a titanium alloy material containing at least one dispersoid forming alloy addition:
(b) hydrogenating the alloy material to a level of about 0.1 to 4.0 weight percent hydrogen;
(c) introducing the resulting hydrogenated material into a mold;
(d) hot compacting the alloy material in the mold to produce a substantially fully dense article;
(e) beta heat treating the compacted article; and,
(f) dehydrogenating the article.

Following heat treatment, the microstructure in the article will be lenticular transformed beta which is highly creep resistant, while size of the dispersoid will be approximately the same as before the heat treatment, due to the relatively low beta treatment temperature.

10 Claims, No Drawings

METHOD TO PRODUCE DISPERSION STRENGTHENED TITANIUM ALLOY ARTICLES WITH HIGH CREEP RESISTANCE

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloys, particularly to dispersion strengthened titanium alloys.

The high strength-to-density ratio of titanium makes it a very attractive design choice in energy-efficient high thrust-to-weight gas turbine engines or airframes of modern airplanes. In titanium, the alloying elements tend to stabilize either the low-temperature close-packed hexagonal alpha phase, or the higher temperature allotrope, body-centered cubic beta phase. Titanium alloys for aerospace applications generally contain both alpha and beta stabilizing elements in various proportions depending on the application and, therefore, the required mechanical properties. The variety of compositions in titanium alloys arises in part because certain alloys are designed for optimization of certain properties. For example, for short-term strength, a relatively high beta stabilizer content is required, while for long-term creep strength, a relatively higher alpha stabilizer content is required.

The important high-temperature properties for aerospace related applications of titanium alloys are: tensile strength, creep, fatigue initiation and fatigue crack propagation resistance, fracture toughness, hot salt stress and corrosion cracking, and oxidation resistance. In addition to selection of an alloy composition, processing of an alloy can be employed to provide desired properties.

In near-alpha and alpha+beta titanium alloys, the creep strength may be substantially increased by heat treating or processing the material above the beta transus temperature to obtain large beta grain size and a transformed beta lenticular alpha morphology.

The creep resistance of titanium alloys can also be improved by dispersion strengthening alloying additions, such as metalloids or rare earth oxides or oxysulfides, to the alloy matrix. Such additions form second phase particles which, if spherical, if small enough, and if uniformly distributed throughout the matrix, provide barriers which prevent dislocation movement such that the resistance of the material to high temperature deformation, and hence the high temperature strength of the material, is increased. In order to provide a stable dispersion to prevent movement of dislocations, the precipitates must be fine, i.e., on the order of less than about 1000 Angstroms in diameter, uniformly dispersed throughout the matrix, spherical in structure, and of relatively high volume fraction, i.e., about 5% or greater. However, dispersoids tend to coarsen with increasing temperature, so that ultimately they become ineffective for creep resistance if the material is exposed to high temperature during processing or during service.

Therefore, in near alpha and alpha+beta titanium alloys containing dispersoids, it is difficult to obtain a large beta grain size, a transformed beta lenticular alpha morphology, and a fine dispersoid structure, the desirable combined microstructural characteristics for high temperature creep resistance, at the same time, by conventional means. While high temperature treatment or processing may result in desired beta and alpha grain structure, the material will develop an undesirably coarse dispersoid structure.

It is an object of the present invention to provide a method to produce titanium alloy articles having high creep resistance.

Other objects and advantages of the present invention will be apparent to those skilled in the art from the following description of the invention.

SUMMARY OF THE INVENTION

In accordance with the present invention, there is provided a method to produce titanium alloy articles having high creep resistance which comprises the steps of:

(a) providing a titanium alloy material containing at least one dispersoid forming alloy addition;

(b) hydrogenating the alloy material to a level of about 0.1 to 4.0 weight percent hydrogen;

(c) indroducing the resulting hydrogenated material into a mold;

(d) hot compacting the alloy material in the mold to produce a substantially fully dense article;

(e) beta heat treating the compacted article; and, (f) dehydrogenating and article.

DESCRIPTION OF THE INVENTION

As noted above, the method of the present invention involves the diffusion of hydrogen into a titanium alloy containing a rare earth metal, hot compacting the thus-hydrogenated material in a mold to produce a substantially fully dense article, beta heat treating the article, and dehydrogenating the article.

The titanium alloys useful in the practice of the present invention are the near alpha, alpha+beta and intermetallic (e.g., $Ti_3Al$) titanium alloys containing at least one dispersion strengthening addition, such as, for example, rare earths such as Y, La, Ce, Pr, Nd, Tb, Dy, Ho, Er, Lu, Th, including the oxides and oxysulfides thereof, and metalloids based on silicon, carbon and boron. The amount of dispersion strengthening addition incorporated into the titanium alloy is about 0.1 to 10.0 atomic percent, preferably about 0.1 to 5.0 atomic percent, more preferably about 0.1 to 1.0 atomic percent.

With respect to processing of the alloy, first a relatively homogeneous alloy is made in a suitable apparatus, such as a melt furnace. Subsequently, the alloy is rapidly solidified using an apparatus of conventional design to produce a ribbon, flake or powder which has a cross-section of about 20 to 30 micrometers with a cooling rate of about $10^4$ to $10^6$ K/sec. In a presently preferred embodiment, the cooling rate permits formation of spherical precipitates in the 50–500 Angstrom diameter range.

The rapidly solidified material is hydrogenated to a level of about 0.1 to 4.0 weight percent hydrogen, preferably about 0.5 to 1.5 weight percent hydrogen, using any conventional technique. Inasmuch as hydrogen is known to embrittle titanium alloys, the hydrogenated alloy material may, if desired, be crushed to powder.

The thus-hydrogenated material is then introduced into a suitable mold. The mold may be a metal can, ceramic mold or a fluid die mold. The ceramic mold process relies basically on the technology developed by the investment casting industry, in that molds are prepared by the lost-wax process. In this process, wax patterns are prepared as shapes intentionally larger than the final configuration. This is necessary because in powder metallurgy a large volume difference occurs in going from the wax pattern (which subsequently becomes the mold) to the consolidated compact. Knowing the configuration aimed for in the compacted shape, allowances can be made using the packing density of the powder to define the required wax pattern shape.

In the metal can technique, a metal can is shaped to the desired configuration by state-of-the-art sheet metal methods, e.g., brake bending, press forming, spinning, superplastic forming, etc. The most satisfactory container appears to be carbon steel, which reacts minimally with the titanium, forming titanium carbide when then inhibits further reactions. Fairly complex shapes have been produced by this technique. Allowance for packing of the powder is incorporated into the metal can dimensions, just as for the ceramic mold.

In the metal can and ceramic mold processes, the powder-filled mold may be supported in a secondary pressing medium contained in a collapsible vessel, e.g., a welded metal can. Following evacuation and elevated-temperature outgassing, the vessel is sealed, then placed in an autoclave or other apparatus capable of hot isostatically compressing the vessel. Consolidation of the titanium alloy powder is accomplished by applying a pressure of at least about 10 ksi, preferably at least about 30 ksi, at a temperature of about 450 to 1100 degrees C. for about 0.25 to 24 hours. Consolidation can be carried out using hot isostatic pressing (HIP), rapid omnidirectional compaction (ROC) or other known techniques. The preferred consolidation technique is that, such as ROC, which has a relatively short preheating and pressure cycle time. Regardless of the consolidation technique employed, it is important that the consolidation temperature be lower than the hydrogenated-beta-transus temperature of the alloy used in order to retain the desired microstructure and prevent dispersoid coarsening in the consolidated article. Hydrogenated titanium alloy powder has a hydrogenated-beta-transus temperature generally about 100 to 300 degrees C. lower than the normal-beta-transus temperature of an alloy. For example, Ti-6A1-4V has a normal beta-transus temperature of about 1000 degrees C., and when hydrogenated to about 0.5 to 1.5 weight percent hydrogen, has a hydrogenated-beta-transus temperature of about 760 to 870 degrees C. In general, consolidation is carried out at a temperature about 25 to 100 degrees C. below the hydrogenated-beta-transus temperature.

Following consolidation, the compacted article is beta heat treated. Beta heat treatment comprises heating the article to a temperature greater than the hydrogenated-beta-transus temperature, but less than the normal beta-transus temperature, followed by cooling to room temperature. The time for heat treatment will vary depending, inter alia, on the cross-section of the article being treated, but in general will be about 15 to 120 minutes. For hydrogen levels up to about 1.0 weight percent, the heated article can be quenched or cooled at any slower cooling rate. For hydrogen levels above 1.0 weight percent, the heated article should be air- or furnace-cooled. The article may be heat treated while still in the mold, either while inside the aforementioned collapsible vessel or after removal from the collapsible vessel, or after recovery from the mold. The article is then recovered from the mold using techniques known in the art, such as acid etch removal of the mold.

Following heat treatment, the microstructure in the article will be lenticular transformed beta which is highly creep resistant, while size of the dispersoid will be approximately the same as before the heat treatment, due to the relatively low beta treatment temperature.

Dehydrogenation may be accomplished by heating the article under vacuum to a temperature of about 200 to 350 degrees C. below the normal beta-transus temperature of the alloy. The time for hydrogen removal will depend on the size and cross-section of the article, the volume of hydrogen to be removed, the temperature of dehydrogenation and the level of vacuum in the apparatus employed. The term "vacuum" is intended to mean a vacuum of about $10^{-2}$ mm. Hg or less, preferably about $10^{-4}$ mm. Hg or less. The time for dehydrogenation must be sufficient to reduce the hydrogen content in the article to less than the maximum allowable level. For example, for the alloy Ti-6A1-4V, the final hydrogen level must be below about 120 ppm to avoid degradation of mechanical properties. Generally, about 15 to 60 minutes at dehydrogenation temperature and under vacuum, is sufficient to ensure substantially complete evolution of hydrogen from the article.

The present invention finds particular utility in the fabrication of titanium alloy parts for high temperature applications, such as aircraft turbine blades and high temperature bearings.

Various modifications may be made in the present invention without departing from the spirit thereof or the scope of the appended claims.

We claim:

1. A method to produce titanium alloy articles having high creep resistance which comprises the steps of:

(a) providing a titanium alloy material containing a dispersoid forming alloying addition;

(b) hydrogenating the alloy material to a level of about 0.1 to 4.0 weight percent hydrogen;

(c) introducing the resulting hydrogenated material into a mold;

(d) hot compacting the alloy material in the mold to produce a substantially fully dense article;

(e) beta heat treating the compacted article; and, (f) dehydrogenating the article.

2. The method of claim 1 wherein said alloy material is a near-alpha or alpha+beta alloy.

3. The method of claim 1 wherein said dispersoid forming alloying addition is present in said alloy in a concentration between 0.1 and 10.0 atomic percent.

4. The method of claim 1 wherein said dispersoid forming alloying addition is present in said alloy in a concentration between 0.1 and 5.0 atomic percent.

5. The method of claim 1 wherein said dispersoid forming alloying addition is present in said alloy in a concentration between 0.1 and 1.0 atomic percent.

6. The method of claim 1 wherein said alloy material is rapidly solidified.

7. The method of claim 6 wherein said material is in powder form.

8. The method of claim 6 wherein said material is in ribbon form.

9. The method of claim 1 wherein said alloy material is hydrogenated to a level of about 0.5 to 1.5 weight percent hydrogen.

10. The method of claim 1 wherein said dispersoid forming alloying addition is a rare earth.

* * * * *